US010925357B2

(12) United States Patent
Zuluaga Escobar

(10) Patent No.: US 10,925,357 B2
(45) Date of Patent: Feb. 23, 2021

(54) RING FOR FINGERS

(71) Applicants: Borsari Giampiero, Diano Marina (IT); Jain Manoj, Dubai (AE)

(72) Inventor: Andres Mauricio Zuluaga Escobar, Valenza (IT)

(73) Assignees: Borsari Giampiero, Diano Marina (IT); Jain Manoj, Dubai (AE)

( * ) Notice: Subject to any disclaimer, the term of this patent is extended or adjusted under 35 U.S.C. 154(b) by 0 days.

(21) Appl. No.: 15/778,983

(22) PCT Filed: Mar. 24, 2017

(86) PCT No.: PCT/IB2017/051721

§ 371 (c)(1),
(2) Date: May 24, 2018

(87) PCT Pub. No.: WO2017/163225

PCT Pub. Date: Sep. 28, 2017

(65) Prior Publication Data

US 2018/0352916 A1 Dec. 13, 2018

(30) Foreign Application Priority Data

Mar. 24, 2016 (IT) ..... UA2016A002012

(51) Int. Cl.
*A44C 9/02* (2006.01)

(52) U.S. Cl.
CPC ..... *A44C 9/02* (2013.01)

(58) Field of Classification Search
CPC ..... A44C 9/02
USPC ..... 63/15.45, 15.5, 15.6, 15.65
See application file for complete search history.

(56) References Cited

U.S. PATENT DOCUMENTS

| | | | | |
|---|---|---|---|---|
| 8,573,004 | B2 | 11/2013 | Demeglio | |
| 9,763,500 | B2 * | 9/2017 | Escobar | A44C 9/02 |
| 2007/0137249 | A1 | 6/2007 | Czajka | |
| 2009/0056373 | A1 * | 3/2009 | Czajka | A44C 5/0084 63/3 |
| 2015/0296932 | A1 | 10/2015 | Escogar | |

FOREIGN PATENT DOCUMENTS

| | | |
|---|---|---|
| DE | 1140768 B | 12/1962 |
| FR | 1582788 A | 10/1969 |

OTHER PUBLICATIONS

International Search Report and Written Opinion dated Jun. 6, 2017 from International Patent Application No. PCT/IB2017/051721 filed Mar. 24, 2017.

* cited by examiner

*Primary Examiner* — Jack W Lavinder
(74) *Attorney, Agent, or Firm* — David B. Tingey; Bryant J. Keller; Kirton McConkie

(57) ABSTRACT

The ornamental ring for fingers comprises:

one crown element to be fitted around a finger of a user and having an inner hollow space; and adjusting means of the inner diameter of the crown element comprising at least two adjusting elements movable between an enclosed configuration wherein the inner diameter is minimum and an enlarged configuration wherein the inner diameter is maximum;

in which the adjusting means comprise an elastic element of annular shape inserted into the inner space and interposed between the crown element and the adjusting elements.

20 Claims, 4 Drawing Sheets

RING FOR FINGERS

CROSS REFERENCE TO RELATED APPLICATION(S)

This application is a U.S. National Stage Entry of International Patent Application No. PCT/IB2017/051721, filed Mar. 24, 2017, which claims the benefit of Italian Patent Application No. 102016000031265, filed Mar. 24, 2016, the disclosures of which are hereby incorporated entirely herein by reference.

BACKGROUND

Technical Field

The present invention relates to an ornamental ring for fingers.

Background Art

With reference to the goldsmith sector, it is known to use rings wearable as an ornament on one or more fingers of a hand.

The known rings comprise a crown element which can be fitted around a finger of a user and is made of the most diverse materials, from less valuable such as plastic, wood, bone or glass, to the most valuable ones such as gold, silver and platinum.

The different types of ring differ from each other, besides for the different constituent materials, even for the decorations that are made on them and which may include embedded stones or engraving reproducing motifs or letters, and for the dimensions of the crown element which are chosen by the users according to the size of fingers.

To date, a first type of rings has the crown element made in a single monolithic body with inner diameters, and thus sizes, which are different according to the size of the user's finger.

This type of ring has several drawbacks among which the fact that, if the ring size is unsuitable to the size of the user's fingers, e.g. in the case in which the crown element has an extremely reduced inner diameter, wearing the ring is particularly annoying and sometimes even impossible.

On the contrary, in the event of the crown element having a greater inner diameter than the size of the user's fingers, the ring is likely to slide out of the finger thus increasing the risk of fortuitous loss of the ring itself.

Furthermore, the fact should be taken into account that fingers are subject to physiological changes in their dimensions due e.g. to temporary swelling; even in case of such contingencies, wearing the ring is particularly annoying.

Further still, in case of particular conformations of the fingers, such as with large knuckles or different thickenings, fitting the ring and pulling it out is particularly difficult and often requires the application of forces, causing the reddening of the skin affected to such friction.

To this is added the fact that the crown element manufacturing process allows to make changes in its inner diameter only by means of goldsmith operations, leading to high expenditure of time and money by the user who often sees the possibility of wearing his/her ring postponed.

One should also bear in mind that the goldsmith operations affect aesthetics and the final visual effect of the ring.

For example, in case of rings having embedded stones, the increase or decrease in the inner diameter of the crown element affects the layout of the stones or of the decorations present on it.

In fact, it is not often possible to make these operations completely consistent with the shapes and decorations of the crown element, thus varying the ring aesthetics and decreasing the intrinsic value of the latter.

To obviate at least in part these drawbacks, the patent documents U.S. Pat. No. 8,573,004 and US 2015/0296932 describe a ring the inner diameter of which is modifiable by means of a mechanical system comprising a plurality of elements operating in conjunction with each other and designed to enable the increase or reduction in the diameter of the crown element according to the size of the user's finger.

However, the types of rings described in the aforementioned documents have some drawbacks among which the fact is included that the assembly job is particularly long and difficult due to the plurality of components making up the inner diameter variation mechanism.

To this is added the fact that the presence of such components causes a considerable increase in the ring final volume, in particular of the crown element, affecting the aesthetics of the ring itself and reducing its comfort during wearing.

In addition, the adhesion of the ring onto the finger, during fitting or pulling it out, is difficult, particularly in case of osteoarthritis or special bone deformations present in the fingers; this means that the diameter of the crown does not vary simultaneously with the aforesaid conformation changes.

DESCRIPTION OF THE INVENTION

The main aim of the present invention is to provide an ornamental ring for fingers that allows varying the inner diameter of the crown element simultaneously with the variations in the sizes of the user's fingers Another object of the present invention is to provide an ornamental ring for fingers that has a rapid assembly and instant and easy execution process.

Still another object of the present invention is to provide an ornamental ring for fingers that has reduced volumetric dimensions, in particular that the crown element is of reduced dimensions compared to known types of ring, leading to a substantial improvement in the ring pleasantness and comfort during its wearing and, at the same time, in the final aesthetics of the ring itself.

A further object of the present invention is to provide an ornamental ring for fingers which allows to overcome the mentioned drawbacks of the prior art in the ambit of a simple, rational, easy, effective to use and low cost solution.

The above mentioned objects are achieved by the present ornamental ring for fingers having the characteristics of claim 1.

DESCRIPTION OF THE DRAWINGS

Other characteristics and advantages of the present invention will become better evident from the description of a preferred, but not exclusive embodiment of an ornamental ring for fingers, illustrated by way of an indicative, but non-limiting, example in the accompanying drawings, wherein.

EMBODIMENTS OF THE INVENTION

Figure 1:
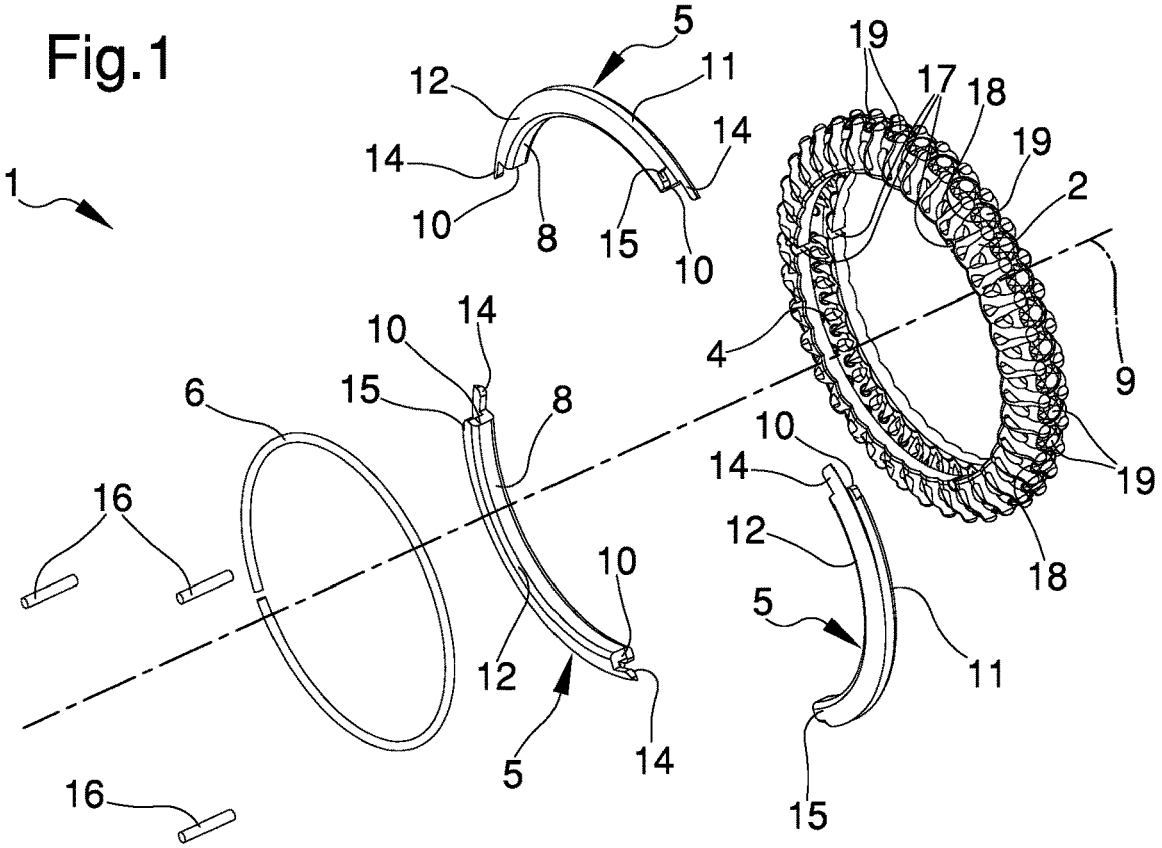
FIG. 1 is an exploded view of the ring according to the invention and in a first embodiment.
Figure 2:
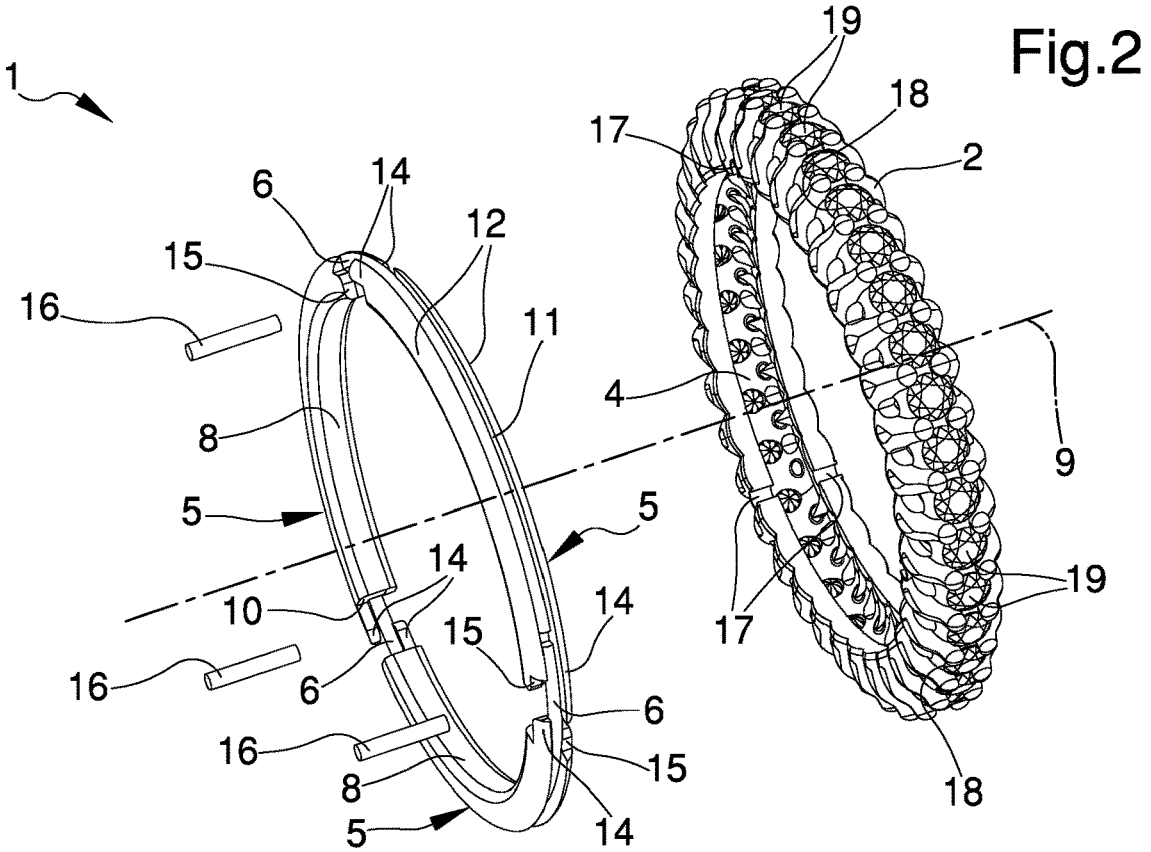
FIG. 2 is a partially exploded view of the ring according to the invention and in a first embodiment.

With particular reference to such figures, reference numeral 1 globally designates an ornamental ring for fingers.

The ring element 1 comprises a crown element 2 which can be fitted around a finger 3 of a user and having an inner hollow space 4.

The crown element 2 has an annular shape.

The ring 1 comprises at least one containment seat 18 of a decorative element 19 made on the crown element 2.

Preferably, the decorative element 19 is selected from the group comprising: precious stones, semi-precious stones, minerals, gems and pearls.

With reference to a first embodiment represented in FIGS. 1-6, the ring 1 comprises a plurality of containment seats 18 accommodating respective decorative elements 19, e.g. of the type of precious stones.

In detail, in the above mentioned embodiment, the containment seats 18 are made on the crown element 2 without protruding from the latter; this means that each decorative element 19 is housed inside the respective containment seat 18 protruding from the latter in a skimming fashion.

Figure 8:
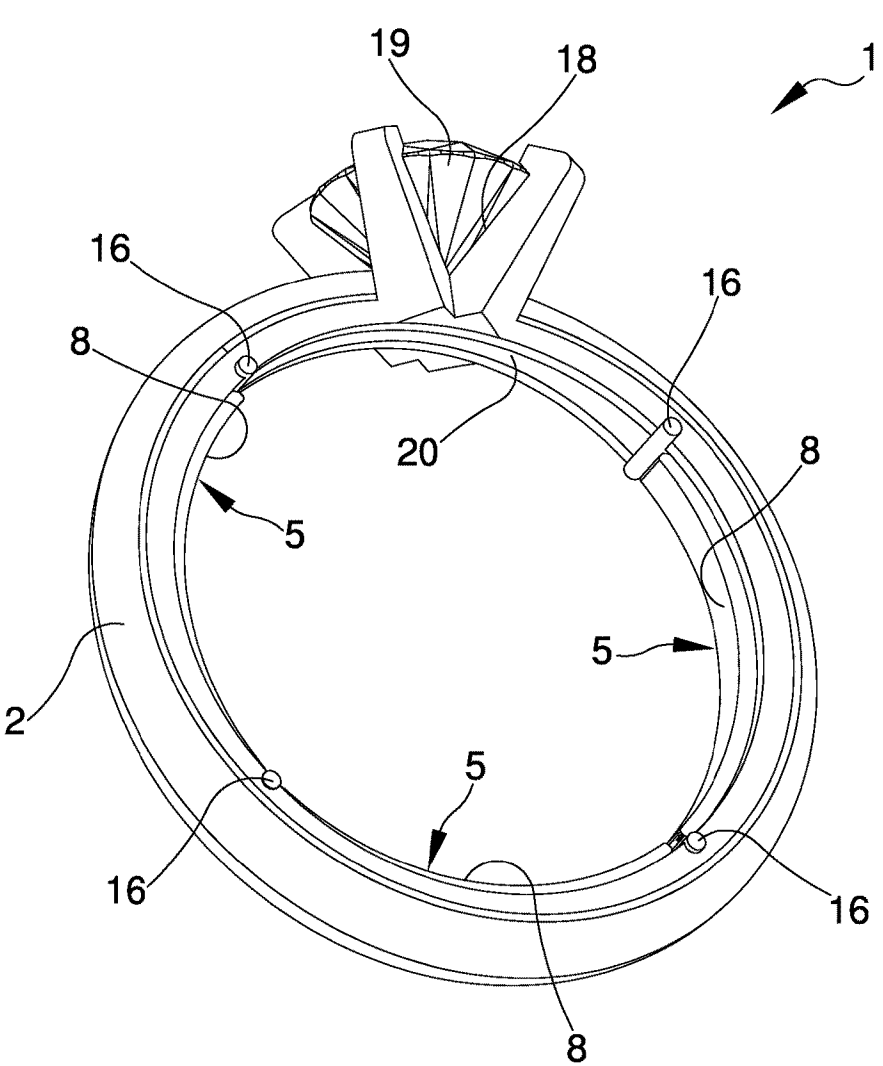
FIG. 8 is an axonometric view from below of the ring according to the invention in a third embodiment.
Figure 7:
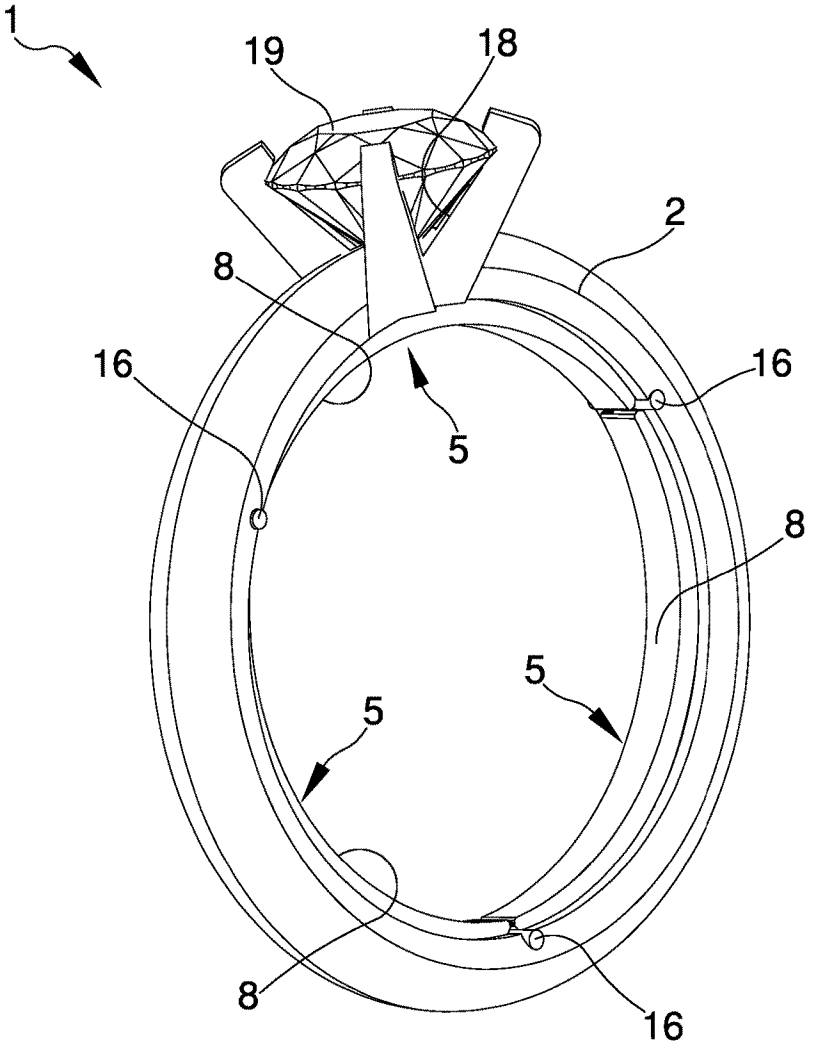
FIG. 7 is an axonometric view of the ring according to the invention in a second embodiment.

Alternatively, as shown in FIGS. 7 and 8, the ring 1 comprises a single containment seat 18 made on the crown element 2 and adapted to accommodate a respective decorative element 19.

In this case, the containment seat 18 is formed protruding from the crown element 2 in a cantilevered fashion; this means that the stone protrudes from the crown element 2 for its entire volume.

As seen in the figures, the crown element 2 has an outer surface having a plurality of embedded stones.

Alternative embodiments cannot however be ruled out in which the outer surface of the crown element 2 has a smooth outer surface, or having other types of decorations such as engraving or the like.

In addition, the ring 1 comprises adjusting means 5, 6 of the inner diameter 7 of the crown element 2.

The adjusting means 5, 6 comprise at least two adjusting elements 5 movable between an enclosed configuration (FIGS. 3 and 4) wherein the inner diameter 7 is minimum and an enlarged configuration (FIGS. 5 and 6) wherein the inner diameter 7 is maximum.

According to the invention, the adjusting means 5, 6 comprise an elastic element 6 of annular shape inserted into the inner space 4 and interposed between the crown element 2 and the adjusting elements 5.

Preferably, the elastic element 6 comprises a traction spring of the type known to the person skilled in the art.

In detail, the adjusting elements 5 are movable between:

- the enclosed configuration (FIGS. 3 and 4) wherein the elastic element 6 is unloaded and the adjusting elements 5 protrude from the inner space 4; and
- the enlarged configuration (FIGS. 5 and 6) wherein the elastic element 6 is loaded due the force applied by the finger 3 on the adjusting elements 5 and the latter are completely inserted inside the inner space 4.

Each adjusting element 5 comprises a thrust surface 8 facing, with respect to a central axis 9 passing through the ring 1, the inside of the crown element 2.

Figure 3:
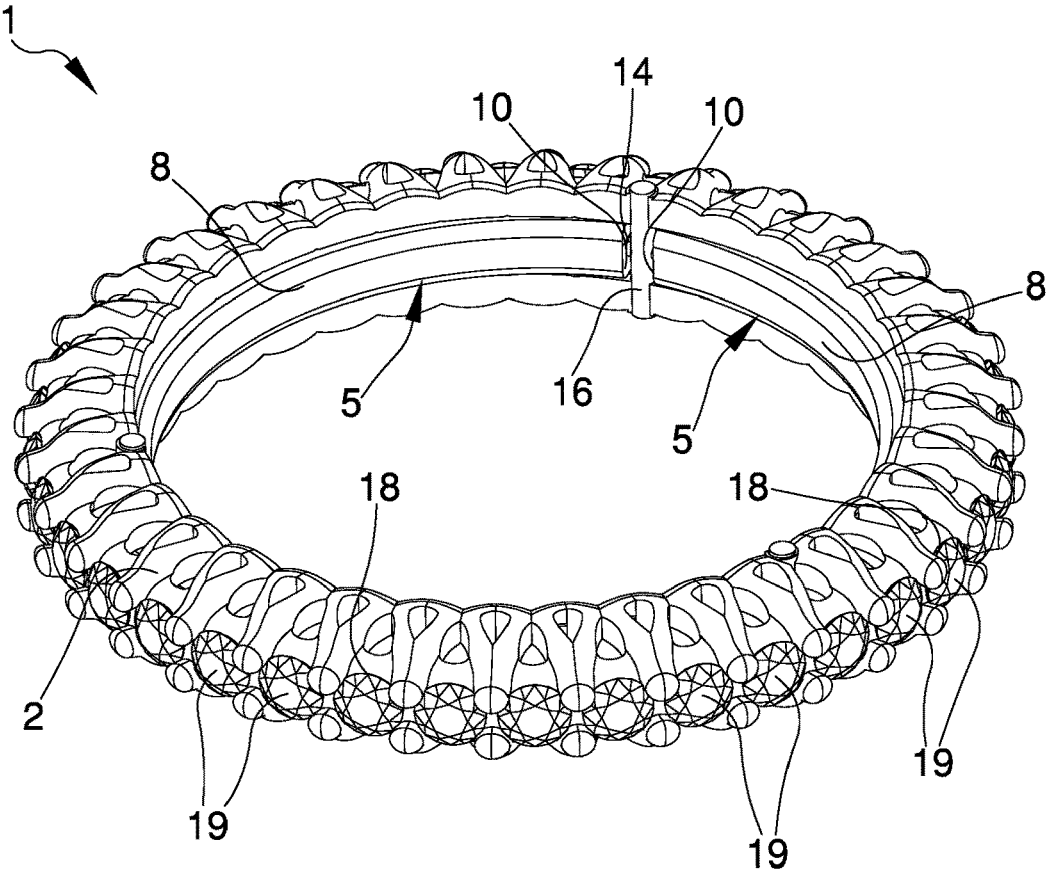
FIG. 3 is an axonometric view of the ring according to the invention in an enclosed configuration, in a first embodiment.
Figure 5:
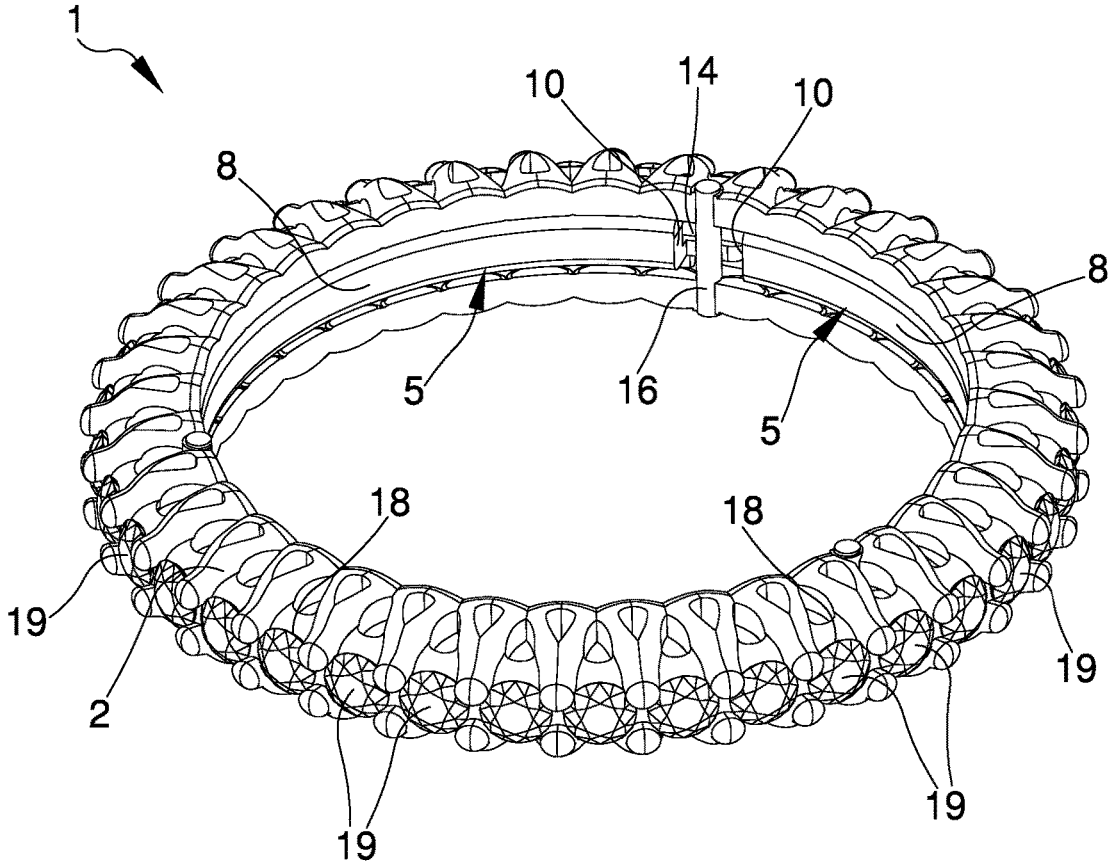
FIG. 5 is a sectional view of the ring according to the invention, in a first embodiment, in an enlarged configuration.

The thrust surface 8 is adapted to come into contact with the finger 3 of the user (FIGS. 3 and 5).

In the enclosed configuration (FIGS. 3 and 4), the adjusting elements 5 protrude from the crown element 2 thus allowing the adhesion of the thrust surface 8 to the finger 3 of the user; this means that the thrust surface 8 is arranged substantially cantilevered with respect to the crown element 2.

At the same time, in the enlarged configuration (FIGS. 5 and 6), the adjusting elements 5, and therefore the thrust surface 8, are completely inserted into the inner space 4; this means that the thrust surface 8 is flush with respect to the crown element 2.

In detail, each adjusting element 5 is movable between the enclosed configuration (FIGS. 3 and 4) and the enlarged configuration (FIGS. 5 and 6) due to the pressure exerted by the finger 3 on the adjusting elements 5.

The adjusting elements 5 are movable, with respect to the central axis 9, in the radial direction (represented in the figures by the arrow A).

In other words, each adjusting element 5 moves, due to the pressure exerted by the finger 3 on the thrust surface 8, along a radius that joins the central axis 9 to the crown element 2.

With reference to the particular embodiment shown in the figures, the adjusting means 5, 6 comprise three adjusting elements 5.

Alternative embodiments cannot however be ruled in which the adjusting means 5, 6 comprise four, five, six, etc. adjusting elements 5.

Each adjusting element 5 has an elongated shape and a substantially curvilinear profile insertable at least in part and to measure inside the inner space 4.

The adjusting elements 5 have shaped extremities 10 complementary to each other that, in an assembly configuration, are arranged adjacent to each other; this means that in the assembly configuration, the extremities 10 are substantially adjacent to each other, thus defining a circumference substantially mating with and coaxial to the crown element 2.

It is useful to point out, moreover, that within the ambit of the present discussion the term "assembly configuration" refers to the ring 1 having the adjusting means 5, 6 associated with the crown element 2 in the corresponding inner space 4.

Advantageously, each adjusting element 5 has an angular extension substantially equal to 120°.

Within the ambit of the present discussion, by "angular extension" is meant the extension expressed in sexagesimal degrees around the central axis 9 and defined respectively by the angular distance between the extremities 10 of each adjusting element 5.

In this case, the adjusting elements 5 comprise a housing seat 11 in which, in the assembly configuration, the elastic element 6 is insertable.

Preferably, the housing seat 11 extends for the entire length of each adjusting element 5.

As can be seen in the figures, the housing seat 11 comprises side walls 12 and a bottom 13 defining with the walls themselves a substantially U-shaped conformation.

The extremities 10 of each adjusting element 5 comprise a projection 14 formed on one of the two side walls 12 and an abutment seat 15 made on the other side wall 12 and adapted, in the assembly configuration, to operate in conjunction with the extremity 10 of the adjacent adjusting element 5.

In fact, in the enclosed configuration (FIGS. 3 and 4) the extremities 10 are moved close to each other, and in the enlarged configuration (FIGS. 5 and 6) they are moved away from each other.

In addition, the ring 1 comprises at least a closing element 20 of at least a portion of the inner space 4. In particular, the closing element 20 is insertable to measure inside the inner space 4.

Preferably, the closing element 20 has a curvilinear profile substantially mating with the profile of the crown element 2.

As can be seen in FIG. 8, the closing element 20 is locked together with the crown element 2.

The ring 1 comprises locking means 16 for locking each adjusting element 5 inside the inner space 4 and allow the mobility thereof from the enclosed configuration (FIGS. 3 and 4) to the enlarged configuration (FIGS. 5 and 6), and vice versa.

As visible in the figures, the locking means 16 comprise a plurality of pin elements that, in the assembly configuration, are associated with the crown element 2 at the extremities 10 of the adjusting elements 5.

In order to facilitate the association of the pin element 16 with the crown element 2, the latter has respective retaining seats 17.

During the assembly step, the pin elements 16 are welded to the corresponding retaining seats 17.

As visible in the figures, the pin elements 16 and the corresponding retaining seats 17 are defined at the extremities 10 of the adjusting elements 5; this way each pin element 16 stops against the projections 14 associated with the respective extremities 10 adjacent to each other.

The operation of the present invention is as follows.

During the assembly step, the extremities 10 of the adjusting elements 5 are arranged adjacent to each other.

In detail, each projection 14 is juxtaposed to the corresponding abutment seat 15 made on the adjacent adjusting element 5.

At this point, the elastic element 6 is inserted inside the housing seat 11 (FIG. 2), making it adhere to the bottom 13 of the housing seat itself; the system formed by the adjusting elements 5 and by the elastic element 6 is inserted inside the inner space 4.

The thrust surface 8 is turned, with respect to the central axis 9, towards the outside of the inner space 4.

The adjusting elements 5 are locked inside the inner space 4 by means of the insertion of the pin elements 16 into the corresponding retaining seat 17.

In detail, each pin element 16 is locked in an unmovable manner inside the retaining seat 17 by means of welding.

Each pin element 16 and the corresponding retaining seat 17 are formed at the extremities 10 of each adjusting element 5, stopping against the projections 14.

In the assembly configuration, the ring 1 is then fitted around the finger 3 of the user and made to slide along the latter; the thrust surface 8 adheres to the finger 3 of the user and simultaneously moves in the radial direction A depending on the thrusts applied to it by the finger 3; this means that during the insertion of the ring 1, the thrust surface 8 adheres evenly to the finger 3, allowing the simultaneous passage from the enclosed configuration (FIGS. 3 and 4) to the enlarged configuration (FIGS. 5 and 6), and vice versa.

In other words, the displacement of the thrust surface 8 is proportional to the size of the finger 3 of the user.

In the case of a finger 3 having reduced dimensions (FIG. 4), the adjusting elements 5, and therefore the thrust surface 8, protrude with respect to the crown element 2; this means that the adjusting elements 5 are located in an enclosed configuration (FIGS. 3 and 4), and the inner diameter 7 is minimum.

Figure 4:
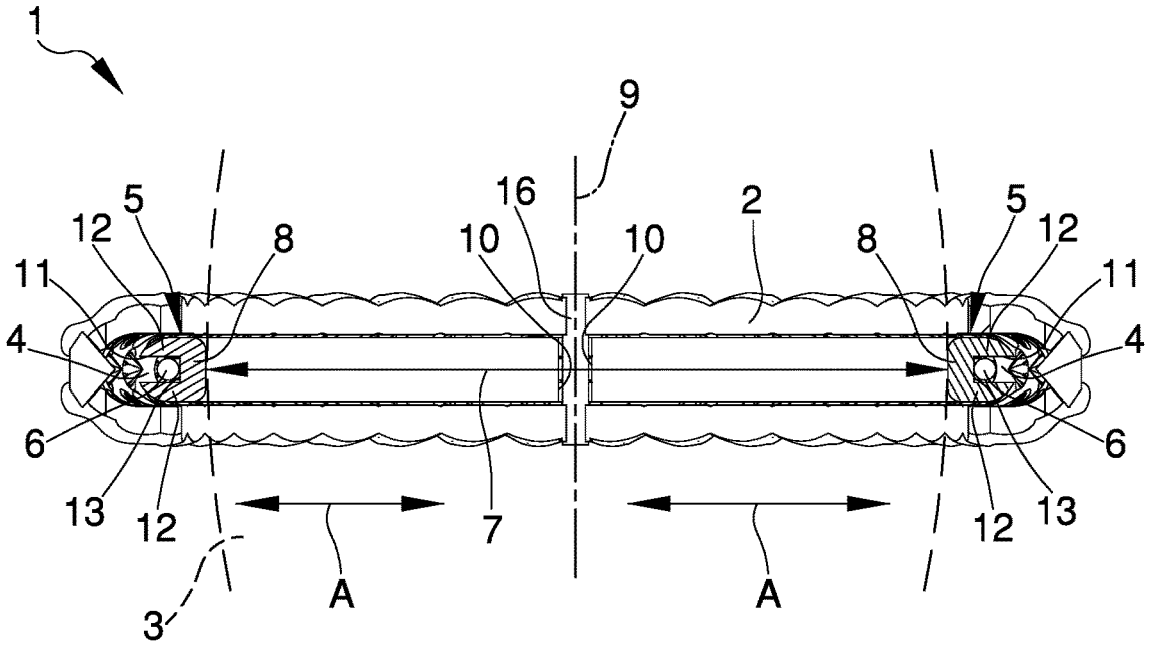
FIG. 4 is a sectional view of the ring according to the invention, in a first embodiment, in an enclosed configuration.

As seen from FIGS. 3 and 4, in the enclosed configuration the extremities 10 of each adjusting element 5 are contiguous with each other and stop against the pin elements 16. In fact in the enclosed configuration, the elastic element 6 is unloaded and each projection 14 is in contact with the respective abutment seat 15.

Figure 6:
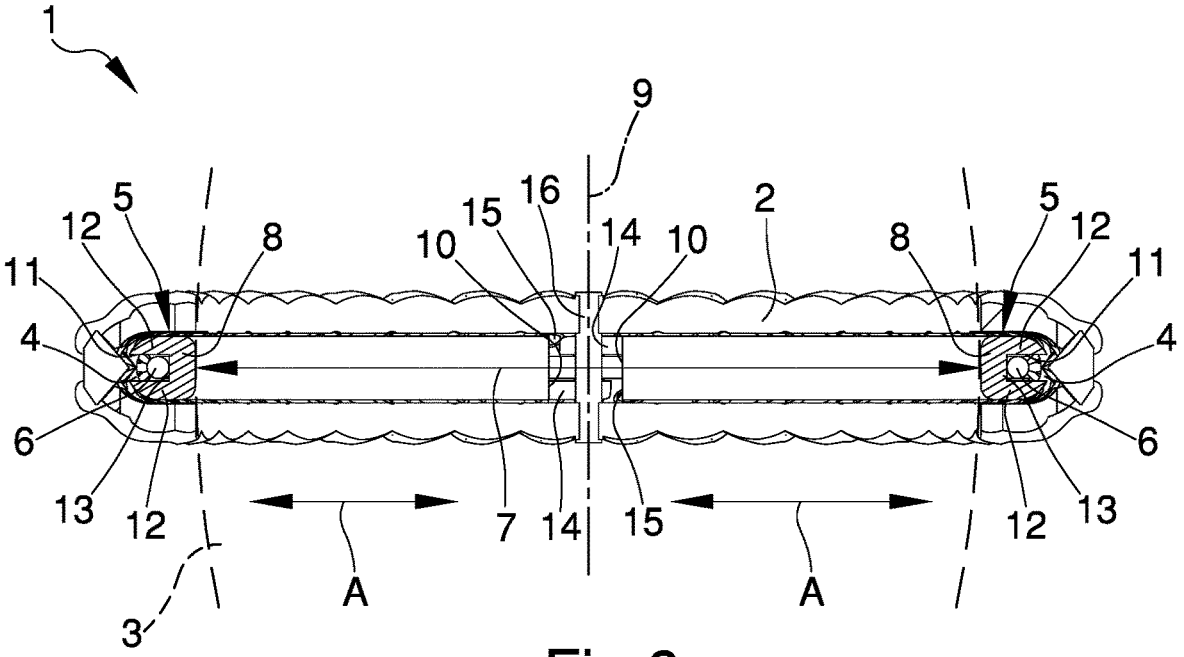
FIG. 6 is a sectional view of the ring according to the invention, in a first embodiment, in an enlarged configuration.

Similarly, in the case of a big finger 3, or thickenings of the latter due for example to the passage through the knuckles, the thrust surface 8 receives a pressure which is proportional to these variations in size and, consequently, determines the passage from the enclosed configuration (FIGS. 3 and 4) to the enlarged configuration (FIGS. 5 and 6). In the enlarged configuration (FIGS. 5 and 6), the elastic element 6, loaded as a result of the pressure exerted by the finger 3 on the adjusting elements 5, determines the moving of the projections 14 away from the respective abutment seats 15 (FIGS. 5 and 6) and the complete insertion of the adjusting elements 5 inside the inner space 4.

Once the pressure exerted by the finger 3 on the thrust surface 8 has finished, the adjusting elements 5 go back to the enclosed configuration and move in the radial direction A.

It has in practice been observed that the described invention achieves the intended objects.

In particular the fact is underlined that the particular solution of providing an elastic element of annular shape interposed between the crown element and the adjusting elements allows for the variation in the inner diameter of the crown element itself simultaneously to the variations in the size of the user's finger.

To this is added the fact that the annular shape of the elastic element enables the even displacement of the adjusting elements, in fact, the thrust surface is adherent to the user's finger and, consequently, is immediately affected by the variations in size of the finger itself.

In addition, the annular shape of the elastic element associated with the corresponding housing seat allows providing a ring having a rapid assembly and immediate and easy execution process, thus also determining a significant decrease in the final volumetric dimensions of the crown element.

The invention claimed is:

1. An ornamental ring for fingers, comprising:

at least one crown element to be fitted around a finger of a user and having an inner hollow space; and adjusting means of an inner diameter of said crown element comprising at least two adjusting elements movable between an enclosed configuration wherein said inner diameter is minimum and an enlarged configuration wherein said inner diameter is maximum, with each of the at least two adjusting elements having laterally asymmetrically shaped extremities, when viewed along a radial line extending from a central axis of the ornamental ring, that are complementary to each other that, when assembled in an assembly configuration, are arranged adjacent to each other;

wherein said adjusting means comprise at least an elastic element of annular shape inserted into said inner hollow space and interposed between said crown element and said at least two adjusting elements, said at least two adjusting elements being movable between:

said enclosed configuration wherein said elastic element is unloaded and said at least two adjusting elements are protruding from said inner hollow space; and said enlarged configuration wherein said elastic element is loaded due to a force applied by said finger of the user on said at least two adjusting elements, such that said at least two adjusting elements are inserted inside said inner hollow space, and wherein said ornamental ring comprises locking means to lock each of said at least two adjusting elements inside said inner hollow space and to allow for mobility of said at least two adjusting elements from said enclosed configuration to said enlarged configuration, as well as for a return from said enlarged configuration to said enclosed configuration.

2. The ornamental ring according to claim 1, wherein said at least two adjusting elements each comprise a housing seat wherein, in said assembly configuration, said elastic element is insertable.

3. The ornamental ring according to claim 2, wherein said housing seat extends for an entire length of each of said at least two adjusting elements.

4. The ornamental ring according to claim 1, wherein each of said at least two adjusting elements has an elongated shape and a substantially curvilinear profile insertable at least in part, and configured to extend, inside and along a portion of said inner hollow space.

5. The ornamental ring according to claim 1, wherein in said enclosed configuration said first end of the first adjusting element and said second end of the second adjusting element are moved toward each other, and in said enlarged configuration are moved away from each other.

6. The ornamental ring according to claim 1, wherein said locking means comprise a plurality of pin elements which, in said assembly configuration, are associated with said crown element at said first end and said second ends of said at least two adjusting elements.

7. The ornamental ring according to claim 1, wherein each of said at least two adjusting elements is movable between said enclosed configuration and said enlarged configuration due to a pressure applied by said finger on each of said at least two adjusting elements.

8. The ornamental ring according to claim 1, further comprising a third adjusting element that is insertable so as to extend inside, and along a portion of, said inner hollow space, with said third adjusting element being locked to said crown element.

9. The ornamental ring according to claim 8, wherein said third adjusting element has a curvilinear profile substantially mating with a profile of said crown element.

10. The ornamental ring according to claim 1, further comprising at least one containment seat of a decorative element.

11. The ornamental ring according to claim 10, wherein said decorative element is selected from a group comprising: a precious stone, a semi-precious stone, a mineral, a gem, and a pearl.

12. The ornamental ring according to claim 10, wherein said containment seat is formed protruding from said crown element in a cantilevered fashion.

13. The ornamental ring according to claim 10, wherein said containment seat is made on said crown element.

14. An ornamental ring for a finger, the ornamental ring comprising:

a crown element that defines an inner hollow space and that is configured to be fitted around the finger;

a first adjusting element;

a second adjusting element; and an elastic element, wherein the first and second adjusting elements each comprise an elongated curvilinear object having a first sidewall, a second sidewall, and a bottom, with the first and second adjusting elements being disposed so as to extend into the inner hollow space, wherein a portion of the elastic element is disposed between the first and second sidewalls of the first and second adjusting elements to bias the first and second adjusting elements toward a center of an inner diameter of the ornamental ring and so as to allow the first and second adjusting elements to move further into the inner hollow space to selectively enlarge the inner diameter of the ornamental ring, wherein the first sidewall at a first end of the first adjusting element comprises at least one of a projection and an abutment seat, wherein the second sidewall at the first end of the first adjusting element comprises the other of the at least one of the projection and the abutment seat, and wherein a second end of the second adjusting element comprises a shape that is complementary to, and that is configured to slidably couple with, the first end of the first adjusting element.

15. The ornamental ring according to claim 14, wherein the projection is configured to contact a locking element to retain the first adjusting element within the inner hollow space.

16. The ornamental ring of claim 14, wherein the ornamental ring comprises a pin, and wherein the projection is configured to contact the pin to retain the first adjusting element within the inner hollow space.

17. An ornamental ring for a finger, the ornamental ring comprising:

a crown element that defines an inner hollow space and is configured to be fitted around the finger;

a first adjusting element;

a second adjusting element; and an elastic element, wherein the first and second adjusting elements each comprise an elongated curvilinear object having a first sidewall, a second side wall, and a bottom, with the first and second adjusting elements being disposed so as to extend into the inner hollow space, wherein a portion of the elastic element is disposed between the first and second sidewalls of the first and second adjusting elements to bias the first and second adjusting elements toward a center of an inner diameter of the ornamental ring and so as to allow the first and second adjusting elements to move further into the inner hollow space to selectively enlarge the inner diameter of the ornamental ring, wherein the first sidewall, at a first end of the first adjusting element, comprises a first projection that extends past the bottom of the first adjusting element, and wherein the second sidewall, at a second end of the second adjusting element, comprises an abutment seat that is configured to receive the first projection.

18. The ornamental ring of claim 17, further comprising multiple locking elements that are configured to extend across the inner hollow space, between the bottom, at the first end of the first adjusting element, and the bottom, at the second end of the second adjusting element, and to contact the first projection from the first end of the first adjusting element to retain the first adjusting element within the inner hollow space.

19. The ornamental ring of claim 17, further comprising a third adjusting element, wherein a first end of the third adjusting element mates with a second end of the first adjusting element, wherein a second end of the third adjusting element mates with a first end of the second adjusting element.

20. The ornamental ring of claim 18, wherein the locking elements each comprise a pin that is configured to contact at least one of the first projection, a second projection that extends from a sidewall of the second adjusting element, and a third projection that extends from a sidewall of a third adjusting element.

* * * * *